US007820099B2

(12) United States Patent
Hayashida et al.

(10) Patent No.: US 7,820,099 B2
(45) Date of Patent: Oct. 26, 2010

(54) HOT ROLLED STEEL SHEET EXCELLENT IN CHEMICAL CONVERTIBILITY AND METHOD OF PRODUCTION OF THE SAME

(75) Inventors: Teruki Hayashida, Oita (JP); Masahiro Ohara, Oita (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/578,145

(22) PCT Filed: Nov. 4, 2004

(86) PCT No.: PCT/JP2004/016692

§ 371 (c)(1),
(2), (4) Date: May 3, 2006

(87) PCT Pub. No.: WO2005/045084

PCT Pub. Date: May 19, 2005

(65) Prior Publication Data

US 2007/0138138 A1 Jun. 21, 2007

(30) Foreign Application Priority Data

Nov. 5, 2003 (JP) ..... 2003-375182

(51) Int. Cl.

| | |
|---|---|
| ***C22C 38/04*** | (2006.01) |
| ***C22C 38/00*** | (2006.01) |
| ***C22C 38/14*** | (2006.01) |
| ***C22C 38/12*** | (2006.01) |
| *C25F 3/00* | (2006.01) |

(52) U.S. Cl. ..... 420/120; 420/8; 420/126; 420/127; 420/128; 148/320; 148/337; 216/96

(58) Field of Classification Search ..... 216/83, 216/96; 148/320, 337; 420/8, 120, 126, 420/127, 128

See application file for complete search history.

(56) References Cited

U.S. PATENT DOCUMENTS

2003/0111144 A1* 6/2003 Matsuoka et al. ..... 148/603

FOREIGN PATENT DOCUMENTS

| | | |
|---|---|---|
| JP | 2-138490 A | 5/1990 |
| JP | 10-001748 | 1/1998 |
| JP | 11-050187 A | 2/1999 |
| JP | 2003-155541 A | 5/2003 |

OTHER PUBLICATIONS

Tanahashi et al., English machine transition of JP 2003-155541A, May 30, 2003.*

* cited by examiner

*Primary Examiner*—Roy King
*Assistant Examiner*—Caitlin Fogarty
(74) *Attorney, Agent, or Firm*—Kenyon & Kenyon LLP

(57) ABSTRACT

The present invention provides a high strength hot rolled steel sheet raised in Si content, wherein a conversion coating can be formed homogeneously over the entire surface of the steel sheet, no new step is added in the production of the steel sheet, and quality control is also facilitated, comprising, by mass %, C: 0.03 to 0.15%, Si: 0.8 to 3.0%, Mn: 0.5 to 3.0%, P: 0.07% or less, S: 0.01% or less, Al: 0.015 to 0.1%, N: 0.001 to 0.008%, and, if necessary, having Ti, Nb, etc. added, the oxides on the steel sheet surface having an Si concentration of 3.5% or less and an Mn concentration of 3.5% or less. Preferably, the average roughness Ra is 3.0 μm or less and the pitting due to pickling is an average of 5 or less in 10 μn side squares. The scale after the hot rolling is washed off by dipping the sheet in a solution having an HCl concentration of 7 to 15% and an Fe ion concentration of 4 to 12% at a solution temperature of 80 to 98° C. for 40 sec or more.

4 Claims, No Drawings

HOT ROLLED STEEL SHEET EXCELLENT IN CHEMICAL CONVERTIBILITY AND METHOD OF PRODUCTION OF THE SAME

TECHNICAL FIELD

The present invention relates to hot rolled steel sheet excellent in chemical convertibility which, when chemically converted for priming steel sheet, is formed with a conversion coating homogeneously over its entire surface, and a method of production of the same.

BACKGROUND ART

When coating automobile body parts by electrodeposition and otherwise coating metal surfaces, the practice is to prime the surfaces by chemical conversion. Chemical conversion covers a metal surface by an inert conversion coating to improve the adhesion and corrosion resistance of the coating formed over it.

Further, from the viewpoints of reducing the weight of automobiles and ensuring safety, high strength thin gauge steel sheet is used. For chassis parts etc., hot rolled steel sheet less expensive than cold rolled steel sheet is being used.

Hot rolled steel sheet is produced through hot rolling and pickling steps. In the pickling step, the oxide scale on the steel sheet surface is removed by hydrochloric acid pickling.

The following proposals have been made in the past regarding high strength hot rolled steel sheet improved in chemical convertibility and a method of production of the same. For example, Japanese Patent Publication (A) No. 11-50187 discloses high strength hot rolled steel sheet where the ratio of Si concentration at the surface and inside of the steel sheet is made 1.3 or less to eliminate the problems of the deterioration of the chemical convertibility and the resultant deterioration of the corrosion resistance after coating. As means for obtaining such a ratio of Si concentration, grinding the hot rolled steel sheet after pickling etc. to reduce the Si oxides present on the surface is shown.

Further, Japanese Patent Publication (A) No. 10-1748 discloses high strength hot rolled steel sheet where the ratio of the Vicker's hardness of the surface and inside of the steel sheet is made 0.95 or less so as to improve the chemical convertibility and workability. This covers Ti-containing steel. The deposits on the steel sheet surface are made carbides instead of the Ti oxide $TiO_2$ causing deterioration of the chemical convertibility and thereby obtain the above ratio of hardness. It is considered that $TiO_2$ forms conforming fine deposits and raises the hardness of the steel sheet, while TiC is nonconforming and reduces the hardness of the steel sheet. As the means for this, the hot rolling conditions are shown.

Japanese Patent Publication (A) No. 11-50187

Japanese Patent Publication (A) No. 10-1748

DISCLOSURE OF THE INVENTION

When priming hot rolled steel sheet by chemical conversion, in particular with steel with a high Si content, locations called "bald spots" where no conversion coating is formed sometimes can be observed under a microscope. Such locations later are observed to rust when examined by the naked eye. Even if rust is not observed, after coating, problems such as the coating peeling off arise along with the elapse of time.

The art of Japanese Patent Publication (A) No. 11-50187 limits the ratio of Si concentration of the surface and inside of steel sheet to a specific range, while the art of Japanese Patent Publication (A) No. 10-1748 limits the ratio of hardness of the surface and inside to a specific range so as to improve the chemical convertibility. For this reason, when applying these arts to a production line of hot rolled steel sheet, measurement of the inside of the steel sheet becomes necessary and issues arise in measurement for quality control. Note that in the former case, the value measured at a position ground 0.5 mm from the surface is made the Si concentration of the inside, while in the latter case, the value measured at a position of a depth of ¼ the thickness from the surface is made the hardness of the inside. Further, the art of Patent Document 1 requires a step of grinding the steel sheet surface. The art of Patent Document 2 covers Ti-containing steel with an Si content reduced to 0.8 mass % or less and is a special technique controlling the state of deposits by the hot rolling conditions.

Therefore, the problem to be solved by the present invention is to provide high strength hot rolled steel sheet raised in Si content which enables a conversion coating to be formed homogeneously over the entire surface of the steel sheet in priming, does not add any new step in production of the steel sheet, and facilitates quality control.

Therefore, the inventors engaged in intensive studies on improvement of the chemical convertibility and as a result took note of the oxide concentration of steel sheet surface and the properties of the steel sheet surface, in particular the surface relief or roughness, and discovered that by defining the Si and Mn concentrations of oxides on the steel sheet surface and limiting the pitting or roughness in the pickling to a specific range, the chemical convertibility is extremely improved. The present invention puts this discovery into concrete form and provides hot rolled steel sheet excellent in chemical convertibility produced through a hot rolling and pickling step, comprising, by mass %, C: 0.03 to 0.15%, Si: 0.8 to 3.0%,
Mn: 0.5 to 3.0%, P: 0.07% or less,
S: 0.01% or less, Al: 0.015 to 0.1%,
N: 0.001 to 0.008%, and the balance of Fe and unavoidable impurities, the oxides on the steel sheet surface having, by mass %, an Si concentration of 3.5% or less and an Mn concentration of 3.5% or less.

Further, it provides hot rolled steel sheet excellent in chemical convertibility produced through a hot rolling and pickling step, comprising, by mass %, C: 0.03 to 0.15%, Si: 0.8 to 3.0%,
Mn: 0.5 to 3.0%, P: 0.07% or less,
S: 0.01% or less, Al: 0.015 to 0.1%,
N: 0.001 to 0.008%, and
one or both of Ti: 0.02 to 0.3% and Nb: 0.01 to 0.5%,
Cu: 0.2 to 1.8% and Ni: 0.1 to 2.0%,
Mo: 0.05 to 0.5%,
B: 0.0002 to 0.006%, and
Ca: 0.0005 to 0.005% alone or in combination, and a balance of Fe and unavoidable impurities, the oxides on the steel sheet surface having, by mass %, an Si concentration of 3.5% or less and an Mn concentration of 3.5% or less.

In the above steel sheets of the present invention, the average roughness Ra of the steel sheet surface is 3.0 μm or less and the number of pits of a diameter of 1 μm to 0.3 μm due to the pickling is an average 5 or less in squares of the steel sheet surface when dividing it into 10 μm-side squares.

Further, to solve the above problem, the method of the present invention is a method of production of hot rolled steel sheet excellent in chemical convertibility characterized by, in a pickling step when producing the hot rolled steel sheet of the present invention, dipping the sheet in an aqueous solution having, by mass %, an HCl concentration of 7 to 15%, an Fe ion concentration of 4 to 12%, and a balance of metal ions other than Fe and impurities, at a solution temperature of 80 to 98° C. for 40 sec or more.

Further, it is a method of production of hot rolled steel sheet excellent in chemical convertibility characterized by, in a pickling step when producing the hot rolled steel sheet of the preferred aspects of the present invention, dipping the sheet in an aqueous solution having, by mass %, an HCl concentration of 7 to 15%, an Fe ion concentration of 4 to 12%, and a balance of metal ions other than Fe and impurities, at a solution temperature of 80 to 95° C. for a time of a range of 40 sec or more to when the HCl concentration (mass %)×dipping time (sec) becomes 520 or less.

Further, in the above methods of the present invention, the aqueous solution preferably includes, by mass %, 0.5 to 5% of $HNO_3$.

BEST MODE FOR WORKING THE INVENTION

In the present invention, the ingredients of the steel sheet are limited to the above ranges so as to obtain a high strength and high workability enabling use for chassis parts of automobiles and obtain an excellent chemical convertibility. The reasons for limitation are as follows. The percentages of all elements are percent by mass.

C: If less than 0.03%, the elongation becomes low, while if over 0.15%, the corrosion resistance falls.

Si: If less than 0.8%, the strength and elongation become lower, while if over 3.0%, the pickling ability falls.

Mn: If less than 0.5%, the elongation falls, while if over 3.0%, the pickling ability falls.

P: If over 0.07%, the hole expandability falls and the elongation and other mechanical properties fall.

S: If over 0.01%, the corrosion resistance falls.

Al: If less than 0.015%, oxides of Si and Mn easily form on the steel sheet surface and the chemical convertibility falls, while if over 0.1%, the corrosion resistance falls.

N: If less than 0.001%, the chemical convertibility falls, while if over 0.008%, the elongation falls.

The steel sheet of the present invention may also include, in addition to the above ingredients, as necessary, the following ingredients alone or in combination. When further improving the strength, one or both of Ti and Nb may be added. In this case, if Ti is less than 0.02%, there is little action in improving the strength by formation of carbides and the effect of improvement of the mechanical strength cannot be secured. Even if added over 0.3%, the effect of raising the strength is saturated.

Nb: If less than 0.01%, there is little action in improving the strength and the effect of improvement of the mechanical strength by its addition cannot be secured. Even if added over 0.5%, the effect of raising the strength becomes saturated.

When further increasing the strength, Cu may be added and, in accordance with need, the steel may be heated to a temperature of 450 to 650° C. or so for heat treatment. In this case, if Cu is less than 0.2%, the effect is small, while even if added over 1.8%, the effect becomes saturated. When adding Cu, Ni is added together to prevent cracking of the steel sheet at the time of hot working. The effect of this Ni is exhibited when present in 0.1% or more and becomes saturated at 2.0%.

When further increasing the strength, Mo may be added. In this case, if Mo is less than 0.05%, there is little action in improving the strength by formation of carbides and the effect of improvement of the mechanical strength due to its addition cannot be secured. Even if added over 0.5%, the effect of raising the strength becomes saturated.

Further, it is possible to reduce the aging due to the nitrogen and improve the hole expansion property by adding B. This effect is exhibited when adding B to 0.0002% or more and becomes saturated at 0.006%.

Further, it is possible to add Ca to prevent a drop in the hole expansion property due to formation of MnS. This effect is exhibited when adding Ca to 0.0005% or more and becomes saturated at 0.005%.

In the hot rolled steel sheet of the present invention, the oxides on the steel sheet surface comprised of the above composition of ingredients have, by mass %, a Si concentration of 3.5% or less and an Mn concentration of 3.5% or less.

The hot rolled steel sheet produced through the hot rolling and pickling step is stripped of surface oxide scale by pickling, but with steel sheet having a large Si content, even if completely removing the apparent oxide scale, oxides will partially remain. The present invention solves the problem of chemical convertibility by modifying the oxides to the above state.

The chemical conversion is performed by removing any oil deposited on the steel sheet surface by degreasing, then dipping the sheet in a chemical conversion solution for a predetermined time. By this treatment, Fe ions are dissolved from the steel sheet into the conversion solution, react with the ingredients of the solution, and form a large number of nuclei of converted crystal grains formed by compounds including Fe, Zn, P, O, etc. These grow and form coatings covering the entire surface of the steel sheet. At this time, it is considered necessary to make 10 μm or smaller fine converted crystal grains deposit evenly over the entire surface. If the state of deposition is poor and "bald spot" locations of no deposition are present, the problems of poor adhesion of the coating at the time of application or a drop in the corrosion resistance after the coating will arise.

If the steel sheet becomes high in Si content, the amount of high Si content oxides in the surface scale after the hot rolling will increase. With the usual hydrochloric acid pickling, this will easily remain at the steel sheet surface. If chemically converting steel sheet having residual high Si-content oxides on it, "bald spot" locations of no deposition will easily occur. From this phenomenon, at locations of residual high Si-content oxides, it is believed that the bald spots are formed due to the delay in dissolution of Fe ions and the delay in the reaction for forming converted crystal grains at the time of chemical conversion. Further, bald spots similarly easily occur with residual high Mn-content oxides.

In the hot rolled steel sheet of the present invention, even if oxides remain at the steel sheet surface after pickling, since the oxides have an Si concentration of 3.5 mass % or less and an Mn concentration of 3.5 mass % or less, there is no delay in dissolution of Fe ions in the chemical conversion. Therefore, nuclei grow to the same extent as locations with no oxides so as to form 10 μm or smaller fine converted crystal grains, the surfaces of the oxides as a whole are covered, a conversion coating comprised of fine converted crystal grains is formed deposited uniformly on the entire surface of the steel sheet, and the formation of bald spots can be avoided.

The surface conditions of the steel sheet of the present invention can be judged by identifying oxides by EPMA from the distribution of oxygen at the steel sheet surface etc. and analyzing their Si concentration and Mn concentration. The Si and Mn on the surface of a steel material are usually analyzed by EPMA at an acceleration voltage of 15 kV. In this case, the concentration up to a depth of about 3 μm from the surface most position of the steel sheet is detected.

However, even under these conditions, due to the thickness of the surface oxide layer and the surface roughness etc., sometimes even information of parts deeper than 3 μm is detected. In some cases, the base metal includes Si and Mn. In the present invention, the analysis values of the Si and Mn by EPMA at an acceleration voltage of 15 kV should be 3.5 mass % or less. The concentration does not have to be just of the oxides. It is confirmed that if the steel sheet surface is in such a condition, the chemical convertibility is good.

In the steel sheets of the present invention, even if a coating comprised of fine converted crystal grains is formed evenly over the entire steel sheet by the chemical conversion, rusting sometimes occurs after the chemical conversion. The inventors investigated steel sheets rusted in this way and steel sheets not rusted in detail. As a result, they learned that the surface roughness and microholes of steel sheet are related to rusting. The microholes were formed by pitting due to the pickling.

When there is large surface relief on the steel sheet surface or when there are a large number of microholes present, when rinsing the steel sheet dipped in and lifted up from the chemical conversion solution, chemical conversion solution probably remains in the recesses causing dissolution of Fe ions from the steel sheet to continue and leading to rust.

Further, if the average roughness Ra of the steel sheet surface is 3.0 μm or less and the number of pits due to the pickling is an average 5 or less in squares of the steel sheet surface divided into 10 μm-side squares, the inventors learned that there is no rusting after the chemical conversion. An average of 3 or less is more preferable. "Pit" means a hole of a diameter of 1 μm to 0.3 μm. Rusting is judged by observation by the naked eye right after rinsing and drying after chemical conversion. Steel sheet not rusting right after drying also will not rust later.

Regarding the pitting and average roughness Ra of the steel sheet surface, pitting was measured by cutting out from the steel sheet a sample of a total width×length of about 500 mm and measuring pitting at the surfaces of three locations, that is, positions 150 mm from the two edges and the center in the width direction, in ranges of 100 μm×100 μm divided into 10 μm-side squares. Regarding the average roughness Ra of the steel sheet surface, the average roughness Ra was measured at the same locations. The average roughness Ra was measured based on the method of arithmetic average roughness of JIS B0601. The measuring device for the average roughness Ra is preferably a probe type roughness meter. A Mitsutoyo "SURFTEST SV-400" was used for measurement.

Next, the method of the present invention is a pickling method for producing the above steel sheets of the present invention. The pickling conditions for making the oxides on the steel sheet surface contain, by mass %, an Si concentration of 3.5% or less and an Mn concentration of 3.5% or less are dipping the sheet in an aqueous solution having, by mass %, an HCl concentration of 7 to 15%, an Fe ion concentration of 4 to 12%, and a balance of metal ions other than Fe and impurities at a solution temperature of 80 to 98° C. for 40 sec or more.

The pickling under these conditions may be performed in the usual hot rolled sheet pickling step. The scale on the steel sheet surface is suitably removed and hot rolled steel sheet excellent in chemical convertibility is obtained.

If the HCl concentration is less than 7%, the Fe ion concentration is less than 4%, the solution temperature is less than 80° C., or the dipping time is less than 40 sec, oxides with an Si concentration and Mn concentration exceeding 3.5% will remain at the steel sheet surface. If the HCl concentration is over 15%, the Fe ion concentration is over 12%, or the solution temperature is over 98° C., roughness of the steel sheet surface will occur due to pickling and the chemical convertibility will drop. Preferably, it is effective to make the solution temperature is made 85 to 95° C. for pickling.

Further, in the method of the present invention, the pickling conditions for making the average roughness Ra of the steel sheet surface 3.0 μm or less and making the number of pits due to the pickling an average 5 or less in the squares of the steel sheet surface divided into 10 μm-side squares further limit the above conditions of the present invention. The conditions are dipping the sheet at a solution temperature of 80 to 95° C. for a time of a range of 40 sec or more to when the HCl concentration (mass %)×dipping time (sec) becomes 520 or less.

The pickling under these conditions may be performed in the usual hot rolled sheet pickling step. The scale on the steel sheet surface is suitably removed and hot rolled steel sheet excellent in chemical convertibility is obtained.

If the solution temperature exceeds 95° C. or if dipping for a time of a range where the HCl concentration (mass %)×dipping time (sec) exceeds 520, the surface roughness Ra of the steel sheet after pickling will exceed 3.0 μm, the number of pits due to the pickling will end up exceeding the above range, and rusting will be liable to occur after the chemical conversion.

Further, it is also effective to add nitric acid to the pickling solution and make the $HNO_3$ concentration 0.5 to 5%. In this case, the pickling effect is promoted by the $HNO_3$. When adding $HNO_3$, preferably it is effective to make the solution temperature 80 to 90° C. for the pickling. If the $HNO_3$ concentration is less than 0.5%, no effect appears, while if over 5%, a rough surface results.

EXAMPLES

Hot rolled steel sheets of the ingredients shown in Table 1 were pickled under the conditions shown in Table 2, then were judged for chemical convertibility.

The comparative examples of Table 1 are outside of the range of the present invention in the ingredients marked by the asterisks. The slab heating temperature in the hot rolling was 1200° C., the hot rolling finishing temperature was 880° C., and the sheets were cooled on a hot run table down to 390° C., then coiled at 390° C., then cooled to room temperature. The pickling was performed by dipping cut samples of the sheets in a test pickling tank.

The asterisks marks in Table 2 indicate conditions outside the conditions of the method of the present invention. Further, "ct" in Table 2 is the value of the HCl concentration (mass %)×dipping time (sec).

Table 3 shows the results. The Si and Mn concentrations were analyzed by EPMA by an acceleration is voltage of 15 kV.

The chemical conversion was performed on cut samples of the sheets using a test tank by a method similar to actual chemical conversion. That is, each sheet sample was degreased, dipped in a surface adjusting solution for 30 sec, then dipped in a chemical conversion solution (PBWL35 made by Japan Parkerizing) for treatment for 120 sec, then rinsed and dried. The chemical convertibility was judged by looking for bald spots by observation by an SEM of the steel sheet surface given the conversion coating and by looking for rusting by observation by the naked eye right after drying. Further, the mechanical properties of the steel sheet are shown.

In Table 3, No. 1 to No. 6 and No. 11 to No. 26 of the invention examples were all free of bald spots and rusting after chemical conversion and exhibited excellent chemical convertibility. No. 18 to No. 26 had special elements added to them. No. 18 to No. 23 exhibited improved tensile strength.

No. 18 showed the effect of addition of Ti, No. 19 and No. 20 addition of Ti and Nb, No. 21 and No. 22 addition of Cu and Ni, and No. 23 addition of Mo. No. 24 and No. 25 exhibited improvement of the hole expansion ratio due to the addition of Ca, while No. 26 exhibited improvement of the hole expansion ratio due to the addition of B.

The invention examples all had pickling conditions, as shown in conditions A to E of Table 2, of an HCl concentration×dipping time (ct) of 520 or less. No rusting could be observed even at locations where coatings comprised of fine converted crystal grains were formed.

Nos. 7 to 10 of the comparative examples had pickling conditions outside of the conditions of the present invention. The conditions F of No. 7 had an insufficient dipping time, the conditions of No. 8 had a low solution temperature, the conditions H of No. 9 had a low HCl concentration, and all had an Si concentration of the oxides exceeding 3.5% resulting in bald spots after chemical conversion. The conditions I of No. 10 had a high Fe ion concentration, an Si concentration and Mn concentration of the oxides exceeding 3.5%, bald spots after chemical conversion, and rusting.

No. 27 to No. 33 of the comparative examples had ingredients of the steel sheets outside the range of the present invention. No. 27 had a high amount of C and exhibited rusting. No. 28 had a high amount of Si and an Si concentration of the surface oxides exceeding 3.5%, while No. 29 had a high amount of Mn and an Mn concentration of the surface oxides exceeding 3.5%. Each exhibited bald spots and rusting. No. 30 had a high amount of S, while No. 31 had a low amount of A. In both, while the Si and Mn concentrations of the surface oxides were low, there was rusting. No. 32 had a low amount of N. Even if the Si and Mn concentrations of the surface oxides were low, there were bald spots and rusting. No. 33 had a high amount of P. Even if the Si and Mn concentrations were low, there was rusting.

INDUSTRIAL APPLICABILITY

The present invention improves the chemical convertibility without requiring reduction of the Si content like in the prior art, so provides high strength, high workability hot rolled steel sheet used for reducing weight and securing safety in automobiles etc. where even if not using other additive elements, the strength and workability are not impaired. Further, the sheet can be produced through the usual hot rolling step and pickling step by just adjusting the pickling conditions. Further, the Si concentration and Mn concentration of the steel sheet surface need only be made within suitable ranges, so the quality control is also easy.

TABLE 1

| | | Chemical ingredients (mass %) | | | | | | | |
|---|---|---|---|---|---|---|---|---|---|
| Class | Steel No. | C | Si | Mn | P | S | AL | N | Other |
| Inv. ex. | 1 | 0.03 | 0.9 | 1.5 | 0.006 | 0.003 | 0.021 | 0.0021 | — |
| Inv. ex. | 2 | 0.1 | 2.3 | 1.9 | 0.006 | 0.002 | 0.015 | 0.0034 | — |
| Inv. ex. | 3 | 0.15 | 1.8 | 1.8 | 0.005 | 0.001 | 0.021 | 0.0018 | — |
| Inv. ex. | 4 | 0.12 | 3 | 0.5 | 0.006 | 0.003 | 0.02 | 0.0025 | — |
| Inv. ex. | 5 | 0.11 | 1.3 | 1.3 | 0.006 | 0.003 | 0.018 | 0.001 | — |
| Inv. ex. | 6 | 0.12 | 1.3 | 1.3 | 0.07 | 0.003 | 0.045 | 0.0022 | — |
| Inv. ex. | 7 | 0.12 | 1.2 | 3 | 0.006 | 0.01 | 0.032 | 0.0021 | — |
| Inv. ex. | 8 | 0.12 | 1.2 | 1.3 | 0.006 | 0.002 | 0.1 | 0.008 | — |
| Inv. ex. | 9 | 0.04 | 0.9 | 1.4 | 0.006 | 0.001 | 0.015 | 0.0029 | — |
| Inv. ex. | 10 | 0.04 | 0.9 | 1.4 | 0.007 | 0.001 | 0.018 | 0.0033 | Ti: 0.28 |
| Inv. ex. | 11 | 0.04 | 0.8 | 1.5 | 0.007 | 0.002 | 0.03 | 0.0032 | Ti: 0.09, Nb: 0.01 |
| Inv. ex. | 12 | 0.03 | 0.9 | 1.5 | 0.007 | 0.002 | 0.026 | 0.0022 | Ti: 0.02, Nb: 0.5 |
| Inv. ex. | 13 | 0.11 | 1.3 | 1.5 | 0.007 | 0.003 | 0.042 | 0.0035 | Cu: 0.2, Ni: 0.1 |
| Inv. ex. | 14 | 0.11 | 1.3 | 1.3 | 0.005 | 0.002 | 0.024 | 0.0037 | Cu: 1.8, Ni: 2.0 |
| Inv. ex. | 15 | 0.04 | 0.9 | 1.5 | 0.007 | 0.003 | 0.021 | 0.0019 | Mo: 0.05 |
| Inv. ex. | 16 | 0.04 | 0.9 | 1.5 | 0.007 | 0.001 | 0.021 | 0.0024 | Ca: 0.0002 |
| Inv. ex. | 17 | 0.04 | 0.9 | 1.5 | 0.006 | 0.003 | 0.045 | 0.0033 | Ca: 0.0027 |
| Inv. ex. | 18 | 0.04 | 0.9 | 1.5 | 0.006 | 0.002 | 0.018 | 0.0045 | B: 0.006 |
| Comp. ex. | 19 | 0.19 | 1.2 | 1.5 | 0.007 | 0.003 | 0.02 | 0.0023 | — |
| Comp. ex. | 20 | 0.15 | 3.3 | 1.1 | 0.006 | 0.002 | 0.035 | 0.0018 | — |
| Comp. ex. | 21 | 0.15 | 1.5 | 3.2 | 0.006 | 0.002 | 0.035 | 0.0018 | — |
| Comp. ex. | 22 | 0.15 | 1.5 | 3 | 0.006 | 0.012 | 0.035 | 0.0018 | — |
| Comp. ex. | 23 | 0.05 | 0.9 | 0.8 | 0.005 | 0.002 | 0.009 | 0.001 | — |
| Comp. ex. | 24 | 0.05 | 0.8 | 0.6 | 0.005 | 0.002 | 0.033 | 0.0005 | |
| Comp. ex. | 25 | 0.15 | 1.5 | 1.2 | 0.09 | 0.002 | 0.035 | 0.0018 | — |

* The comparative examples are outside the range of the present invention in the underlined ingredients.

TABLE 2

| | | Pickling conditions | | | | | |
|---|---|---|---|---|---|---|---|
| Class | Symbol | HCl conc. (%) | Fe conc. (%) | $HNO_3$ conc. (%) | Solution temp. (° C.) | Time (sec) | HCl conc. (%) × time (s) |
| Inv. ex. | A | 15 | 7 | 0 | 90 | 19 | 285 |
| Inv. ex. | B | 8 | 12 | 0 | 95 | 35 | 280 |
| Inv. ex. | C | 7 | 7 | 0 | 88 | 39 | 273 |
| Inv. ex. | D | 12.5 | 7 | 0.5 | 88 | 40 | 500 |
| Inv. ex. | E | 15 | 7 | 5 | 88 | 33 | 495 |
| Comp. ex. | F | 8 | 8 | 0 | 90 | 90 | 720 |
| Comp. ex. | G | 8 | 9 | 0 | 70 | 40 | 320 |
| Comp. ex. | H | 7 | 8 | 0 | 85 | 30 | 210 |
| Comp. ex. | I | 15 | 12 | 0 | 85 | 60 | 900 |

* The comparative examples are outside the range of the present invention in the underlined conditions.

TABLE 3

| Class | No. | Steel no. | Pickling conditions | Surface element conc. (wt %) Si | Surface element conc. (wt %) Mn | Surface conditions: Surface aver. rough. Ra (μm) 1) | Surface conditions: Pitting 2) | Chemical convertibility: Bald spots | Chemical convertibility: Rusting after conversion | Mechanical properties: Tensile strength (MPa) | Mechanical properties: Hole expansion ratio (%) |
|---|---|---|---|---|---|---|---|---|---|---|---|
| Inv. ex. | 1 | 1 | B | 1.4 | 1.9 | 1.7 | 3 | None | None | 476 | 91 |
| Inv. ex. | 2 | 2 | A | 2.5 | 2 | 2.1 | 5 | None | None | 564 | 87 |
| Inv. ex. | 3 | 2 | B | 3.1 | 2.4 | 2.0 | 4 | None | None | 564 | 87 |
| Inv. ex. | 4 | 2 | C | 3.1 | 2.3 | 2.0 | 4 | None | None | 564 | 87 |
| Inv. ex. | 5 | 2 | D | 2.8 | 2.1 | 2.1 | 4 | None | None | 564 | 87 |
| Inv. ex. | 6 | 2 | E | 2.6 | 2 | 2.1 | 5 | None | None | 564 | 87 |
| Comp. ex. | 7 | 2 | F | *3.6 | 2.5 | 2.2 | 11 | Yes | Yes | 564 | 87 |
| Comp. ex. | 8 | 2 | G | *3.8 | 2.5 | 2.0 | 5 | Yes | Yes | 564 | 87 |
| Comp. ex. | 9 | 2 | H | *3.6 | 2.6 | 2.0 | 5 | Yes | Yes | 564 | 87 |
| Comp. ex. | 10 | 2 | I | *3.9 | *3.7 | 2.2 | 8 | Yes | Yes | 564 | 87 |
| Inv. ex. | 11 | 3 | B | 2.6 | 2.8 | 1.7 | 5 | None | None | 663 | 36 |
| Inv. ex. | 12 | 4 | B | 3.4 | 0.8 | 2.2 | 4 | None | None | 705 | 31 |
| Inv. ex. | 13 | 5 | B | 1.8 | 1.8 | 1.5 | 3 | None | None | 651 | 33 |
| Inv. ex. | 14 | 6 | B | 1.9 | 1.6 | 1.4 | 3 | None | None | 686 | 28 |
| Inv. ex. | 15 | 7 | B | 1.9 | 3.5 | 1.4 | 3 | None | None | 715 | 26 |
| Inv. ex. | 16 | 8 | B | 2 | 1.6 | 1.4 | 3 | None | None | 709 | 30 |
| Inv. ex. | 17 | 9 | B | 2.1 | 1.9 | 1.2 | 4 | None | None | 491 | 84 |
| Inv. ex. | 18 | 10 | B | 1.5 | 2.2 | 1.2 | 3 | None | None | 675 | 55 |
| Inv. ex. | 19 | 11 | B | 1.4 | 2.3 | 1.2 | 3 | None | None | 741 | 58 |
| Inv. ex. | 20 | 12 | B | 1.4 | 2.2 | 1.2 | 3 | None | None | 685 | 63 |
| Inv. ex. | 21 | 13 | B | 1.5 | 2.3 | 1.4 | 3 | None | None | 701 | 33 |
| Inv. ex. | 22 | 14 | B | 1.6 | 2.1 | 1.4 | 3 | None | None | 766 | 30 |
| Inv. ex. | 23 | 15 | B | 1.4 | 2.2 | 1.3 | 2 | None | None | 522 | 85 |
| Inv. ex. | 24 | 16 | B | 1.5 | 2.2 | 1.2 | 3 | None | None | 492 | 92 |
| Inv. ex. | 25 | 17 | B | 1.6 | 2.1 | 1.3 | 2 | None | None | 499 | 98 |
| Inv. ex. | 26 | 18 | B | 1.6 | 2 | 1.3 | 2 | None | None | 496 | 90 |
| Comp. ex. | 27 | 19 | B | 1.9 | 2.1 | 1.2 | 4 | None | Yes | 692 | 28 |
| Comp. ex. | 28 | 20 | F | *6.5 | 2.5 | 3.1 | 16 | Yes | Yes | 698 | 25 |
| Comp. ex. | 29 | 21 | B | 2.2 | *4.3 | 1.9 | 4 | Yes | Yes | 695 | 26 |
| Comp. ex. | 30 | 22 | B | 2.6 | 3 | 1.4 | 4 | None | Yes | 705 | 25 |
| Comp. ex. | 31 | 23 | B | 1.6 | 1.2 | 1.3 | 3 | None | Yes | 556 | 85 |
| Comp. ex. | 32 | 24 | B | 1.4 | 1.5 | 1.3 | 2 | Yes | Yes | 550 | 88 |
| Comp. ex. | 33 | 25 | B | 2.6 | 1.8 | 1.4 | 3 | None | Yes | 684 | 24 |

1) Ra is measured based on method of arithmetic average roughness of JIS B0601. The measuring device was a Mitsutoyo "SURFTEST SV-400".
2) When dividing steel sheet surface to a grid of 10 μm side squares
Good: Number of pitted parts 5 or less
Poor: Number of pitted parts 6 or less

The invention claimed is:

1. Hot rolled steel sheet excellent in chemical convertibility and free from bald spots, characterized by the steel sheet containing, by mass %, C: 0.03 to 0.15%,
Si: 1.3 to 3.0%,
Mn: 0.5 to 3.0%,
P: 0.07% or less,
S: 0.01% or less,
Al: 0.015 to 0.1%,
N: 0.001 to 0.008%, the steel sheet optionally containing one or more of Ti: 0.02 to 0.3%, Nb: 0.01 to 0.5%, Ni: 0.1 to 2.0%, B: 0.0002 to 0.006%, and Ca: 0.0005 to 0.005%; and the steel sheet being free from containing Cu and Mo, and the balance of Fe and unavoidable impurities, the oxides on the steel sheet surface having, by mass %, a Si concentration of 3.5% or less and a Mn concentration of 3.5% or less, and an average roughness Ra of the steel sheet surface of 3.0 μm or less and an average number of pits of a diameter of 1 μm to 0.3 μm of 5 or less in squares of the steel sheet surface when dividing it into squares of 10 μm per side, the steel sheet obtained by pickling by dipping the steel sheet in an aqueous solution containing, by mass %, a HCl concentration of 7 to 15%, an Fe ion concentration of 4 to 12% and a balance of metal ions other than Fe and impurities, at a solution temperature of 80 to 98° C. for a dipping time such that the HCl concentration (mass %)×dipping time (sec) is 273 to 520.

2. Hot rolled steel sheet excellent in chemical convertibility and free from bald spots as claimed in claim 1, wherein said aqueous solution further contains $HNO_3$ of a concentration of 0.5 to 5 mass %.

3. Hot rolled steel sheet excellent in chemical convertibility and free from bald spots as claimed in claim 1, wherein the dipping time is such that the HCl concentration (mass %)×dipping time (sec) is 280 to 520.

4. Hot rolled steel sheet excellent in chemical convertibility and free from bald spots as claimed in claim 1, wherein the dipping time is 40 sec up to a dipping time such that the HCl concentration (mass %)×dipping time (sec) is 520.

* * * * *